US007010965B2

(12) United States Patent
Cameron

(10) Patent No.: US 7,010,965 B2
(45) Date of Patent: Mar. 14, 2006

(54) GOLF CLUB FIXTURE

(75) Inventor: Don T. Cameron, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/946,240

(22) Filed: Sep. 22, 2004

(65) Prior Publication Data

US 2005/0076708 A1 Apr. 14, 2005

Related U.S. Application Data

(63) Continuation-in-part of application No. 10/644,884, filed on Aug. 21, 2003, now abandoned, which is a continuation of application No. 10/051,058, filed on Jan. 22, 2002, now Pat. No. 6,644,102.

(60) Provisional application No. 60/263,708, filed on Jan. 25, 2001.

(51) Int. Cl.
*A63B 53/00* (2006.01)

(52) U.S. Cl. ..... 73/65.03; 73/65.01; 33/501

(58) Field of Classification Search ..... 73/65.01, 73/65.03; 33/501
See application file for complete search history.

(56) References Cited

U.S. PATENT DOCUMENTS

| | | | | |
|---|---|---|---|---|
| 3,439,429 A | | 4/1969 | Sundstrom | 33/174 |
| 3,631,602 A | | 1/1972 | Noel | 33/508 |
| 3,822,477 A | | 7/1974 | Collins | 33/174 F |
| 4,094,072 A | | 6/1978 | Erb | 33/174 |
| 4,245,392 A | | 1/1981 | Heller | 33/508 |
| 4,620,431 A | | 11/1986 | Muldoon | 72/31 |
| 4,640,017 A | | 2/1987 | Cukon | 33/508 |
| D306,979 S | | 4/1990 | Cukon | D10/46 |
| D316,660 S | | 5/1991 | Cukon | D8/71 |
| D324,897 S | | 3/1992 | Colucci | D21/234 |
| 5,105,550 A | * | 4/1992 | Shenoha | 33/508 |
| D340,653 S | | 10/1993 | Cukon | D10/65 |
| 5,421,098 A | | 6/1995 | Muldoon | 33/508 |
| D376,112 S | | 12/1996 | Cukon | D10/65 |
| 5,884,409 A | * | 3/1999 | Muldoon | 33/508 |
| 5,974,645 A | * | 11/1999 | Currie | 29/407.05 |
| 6,250,168 B1 | | 6/2001 | D'Aguanno | 73/865.3 |
| 6,260,250 B1 | * | 7/2001 | Hall et al. | 29/281.1 |
| 6,363,620 B1 | | 4/2002 | Goodjohn | 33/508 |
| 6,482,101 B1 | * | 11/2002 | Posma | 473/246 |
| 6,644,102 B1 | | 11/2003 | Cameron | 73/65.01 |
| 6,871,414 B1 | * | 3/2005 | Burney et al. | 33/508 |

OTHER PUBLICATIONS

Golf Equipment Universal Catalogue 2000, p. 577.
Mitchell Golf Equipment Company, 2001 Catalog, Golf Club Assembly, Fitting & Repair Equipment, pp. 12-17.

* cited by examiner

*Primary Examiner*—Max Noori
*Assistant Examiner*—Alandra Ellington
(74) *Attorney, Agent, or Firm*—Swidler Berlin LLP

(57) ABSTRACT

A device for measuring alignment of a golf club is provided, and allows measurement of the lie angle and loft angle simultaneously. The strike face of the club is placed against an abutment member that is fixed to a base member, and held in place with a clamping member. An alignment member is coupled to the base member and spaced from the clamping member in generally opposing relation thereto. The alignment member is movable with respect to the clamping member to receive the golf club shaft in a cradle.

20 Claims, 11 Drawing Sheets

GOLF CLUB FIXTURE

CROSS-REFERENCE TO RELATED APPLICATIONS

This application is a continuation-in-part of U.S. patent application Ser. No. 10/644,884, filed Aug. 21, 2003, now abandoned, which is a continuation of U.S. patent application Ser. No. 10/051,058, filed Jan. 22, 2002 now U.S. Pat. No. 6,644,102, which claims priority from Provisional Patent Application No. 60/263,708, filed Jan. 25, 2001. The disclosures of these documents are incorporated herein in their entireties.

BACKGROUND OF THE INVENTION

Technological innovations and a greater understanding of golf swing dynamics have allowed golf club manufacturers to provide a significant level of customization to match golf clubs to a particular golfer according to the golfer's height and preferred stance. Various golf club design parameters may be customized, such as an adjustment of the angular relationship of the golf club head with respect to the shaft and the ground. Such a customization is useful, for example, because when two golfers with dissimilar heights address a golf ball using the same club, the angle formed by the shaft of the club with respect to the ground will invariably be different for each golfer. Similarly, depending on the golfer's stance and playing characteristics, the angle formed by the club face of the golf club will also vary among golfers. Thus, to improve a golfer's performance with a particular club, these are two parameters of the club regarding the relative position of the golf club head to the shaft that are often customized to fit the golfer.

Referring now to FIG. 1, a pair of lines 20, 22 represent the plane of the ground. The first example stated above concerns the golf club's lie angle, which is defined as the angle, $\alpha$, formed between a center line 24 extending through the shaft with the ground line 20 as shown tangent to the sole at the centerline of the club face. To accurately obtained the lie angle $\alpha$ of the golf club, the sole of the club head should be resting at the point just below the center of the club face. Proper lie angle is important to ensure that the golf club makes a square contact with the ball during the execution of a swing. For example, if the lie is less than ideal, the sole of the golf club will most likely be upwardly angled when the club head impacts the ball. As a result, the face of the club head will be aimed to the left of the medial line of the fairway, resulting in a left-of-center flight path. On the other hand, if the lie is greater than ideal, the club's sole will likely be downwardly angled at the point of impact and the opposite effect will be obtained.

The other parameter of the golf club head relative to the shaft is the loft angle, shown as $\beta$ in FIG. 1. The loft angle $\beta$ is generally defined as the angle of the backward slant of the face of a golf club head. More particularly, the loft angle $\beta$ is the angle formed by a line 26 perpendicular to the club face to the ground line 22. The greater the loft angle, the greater the loft of ball after being struck by the golf club.

The measurements of the loft angle, for example, may not be indicative of the performance of the club when used by a particular golfer because the physiological and swing characteristics of the golfer can effect the resultant flight of the ball. Accordingly, in providing a more customized set of clubs for a particular golfer, the loft angle is often personalized to meet the particular physical traits and abilities of the individual golfer.

Moreover, as golfers rely on a golf club having a particular loft and lie angle to perform in a particular fashion, any variation based on use or manufacturing tolerance may be quite undesirable, especially for golfers playing at the professional level. Thus, minor adjustments to the loft and lie are often made to the golf clubs used by professional golfers. Such adjustments are typically required at tournaments, on tour, or at various locations remote from manufacturers. Accordingly, there is a need for a golf club adjustment device that is compact and transportable, while easy to use.

In addition, due to the mass production of golf clubs, fine tuning of each golf club by adjusting the loft and lie of the club is often desirable before the clubs are ready for shipment. Thus, manufacturers often make final adjusts to the loft and lie of the clubs after assembly of the club. Such an operation is highly labor intensive and there is a need for a device that permits adjustments to be made quickly and simply.

Finally, technological innovations have allowed manufacturers to produce golf clubs having various configurations that are designed to meet different performance criteria. Thus, there is a need for a device for measuring and adjusting the loft and lie of a golf club should be configured and adaptable to receive and securely hold golf clubs having varied club head configurations.

SUMMARY OF THE INVENTION

The present invention is directed to a device for measuring alignment of a golf club with a shaft and a head having a strike face and a back face. The golf club may be a putter. The device includes a base member and an abutment member fixed to the base member for abutting the strike face. The device further includes at least one clamping member for abutting the back face, with the at least one clamping member being disposed on the base member and spaced from the abutment member to fix the golf club head in a first direction between the at least one clamping member and the abutment member. The clamping member may be selected from a group of clamping members, with each clamping member of the group being tailored to a specific golf club. The device also includes an alignment member coupled to the base member and spaced from the at least one clamping member in generally opposing relation thereto, with the alignment member being movable with respect to the clamping member to receive the golf club shaft in a second direction. The positioning of the alignment member simultaneously indicates the loft angle and lie angle of the golf club.

In one embodiment, the alignment member is slidably and pivotably mounted, and includes a first indicator for indicating lie and a second indicator for indicating loft. The indicator includes a fixed scale and a movable needle, with the needle being coupled to a cradle for receiving said shaft. The second indicator comprises a movable scale and a fixed needle. The base member may further include at least two leveling bearings for abutting a sole of the head. The alignment member is slidable in a direction generally transverse to the clamping member and pivotable in a direction generally parallel to the clamping member. In addition, the alignment member is slidable in a direction generally parallel to the clamping member.

An adjusting bar may also be provided and includes two protrusions, with the protrusions defining a slot therebetween to receive and contour the shaft. According to one aspect of the invention, each of the protrusions is a wheel rotatably secured to the adjusting bar and having a diameter greater than about 0.1 inches, but less than about 0.25 inches. In one embodiment, the diameter is about ⅜ inch, while the slot is between about 1 to 4 inches, and can be about 2.5 inches.

The present invention is also directed to a fixture for retaining a golf club with a shaft and a head having a strike face. The fixture includes a base plate having a top surface, a reference surface fixed to the base plate, and a clamp assembly coupled to the base plate in spaced relation and generally perpendicular to the reference surface. A carriage is coupled to the base, and a measurement member is disposed in a plane generally perpendicular to the top surface. The measurement member is coupled to the carriage in spaced and opposing relation to the clamp assembly, with the measurement member including a cradle that is rotatably coupled to the measurement member and movable with respect to the clamp assembly to receive the golf club shaft. Retention of the club between the reference surface and the clamp assembly with the strike face abutting the reference surface permits the measurement member to simultaneously indicate a loft angle and a lie angle of the golf club. The measurement member is pivotably coupled to the carriage in a plane generally perpendicular to the top surface, while the carriage is movable in a direction generally transverse to the clamp assembly and in a direction generally parallel to the clamp assembly.

DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE INVENTION

Figure 1:
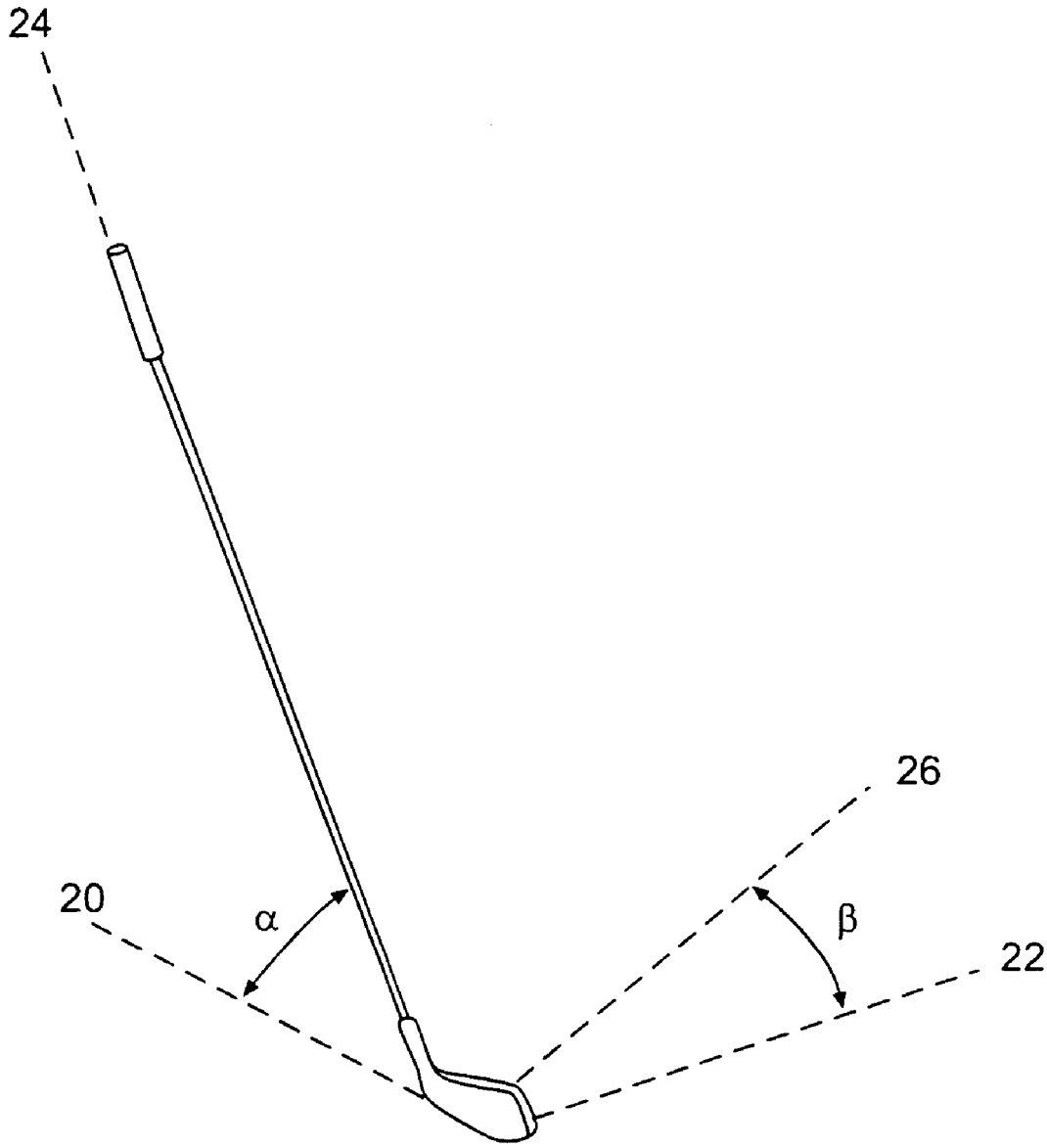
FIG. 1 PRIOR ART
FIG. 1 is a perspective view of a golf club showing the club loft and lie angles.
Figure 2:
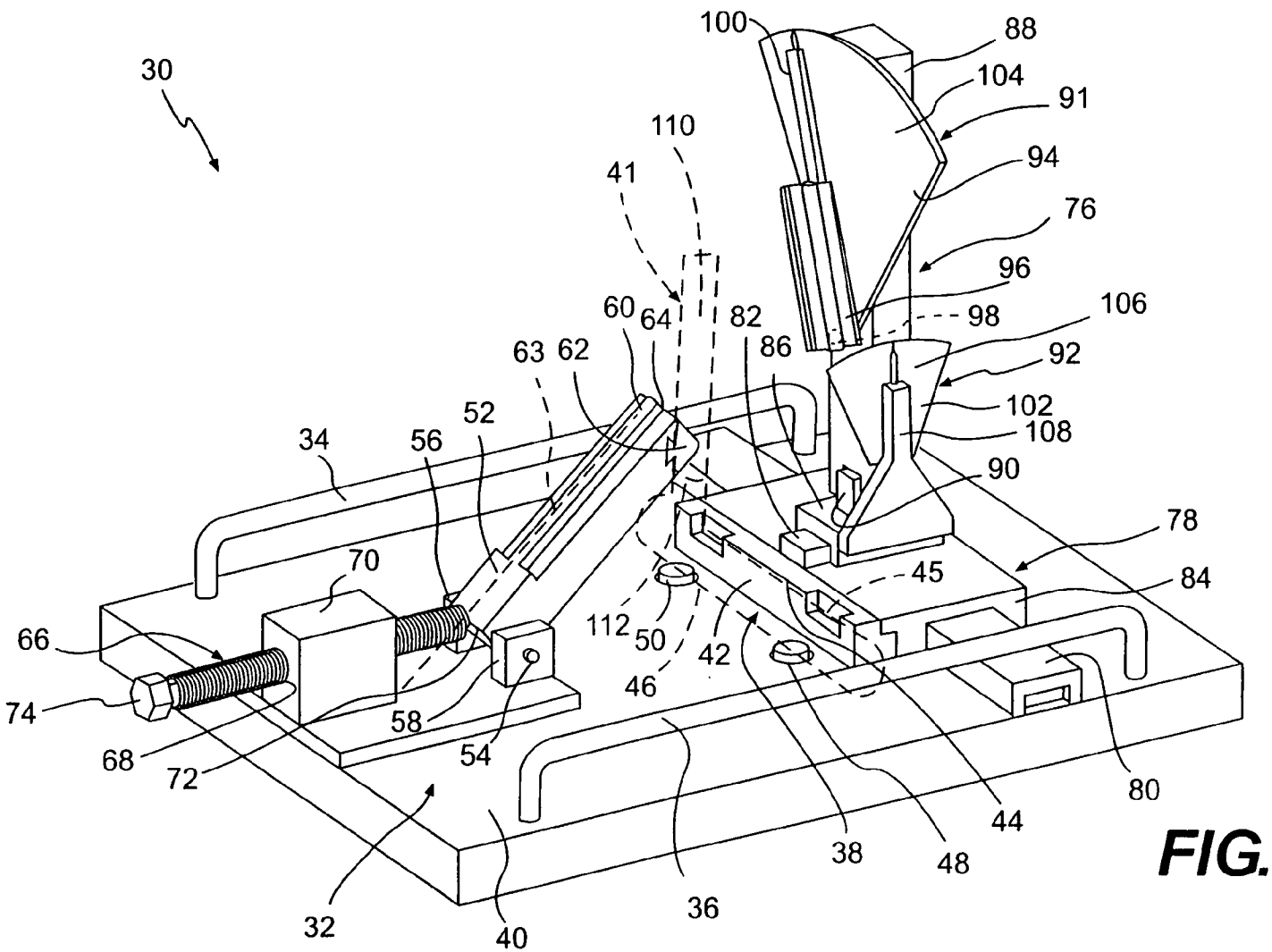
FIG. 2 is a right side, perspective view of a fixture according to the present invention with a putter shown therewith.
Figure 3:
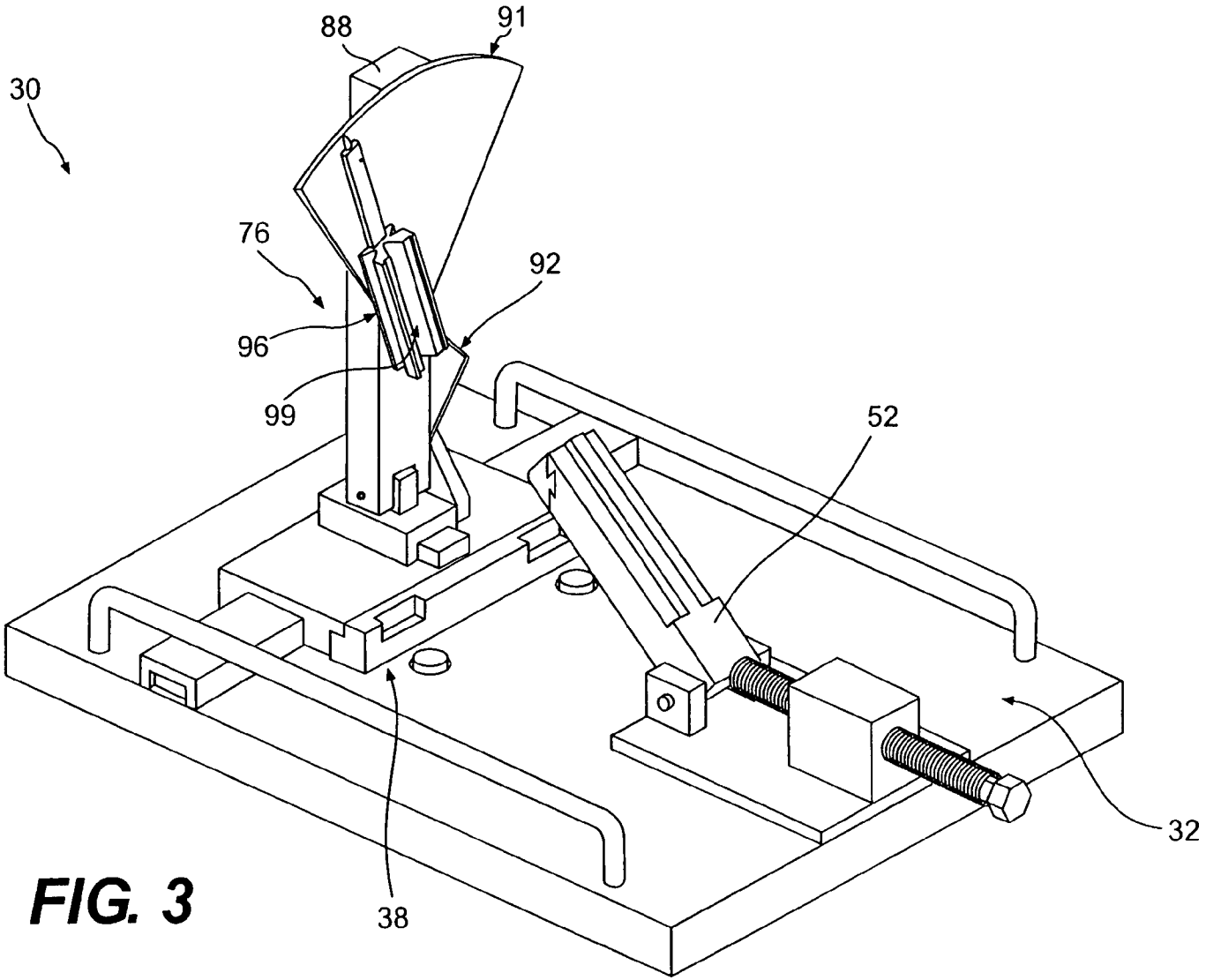
FIG. 3 is a left side, perspective view of the fixture of FIG. 2.
Figure 4:
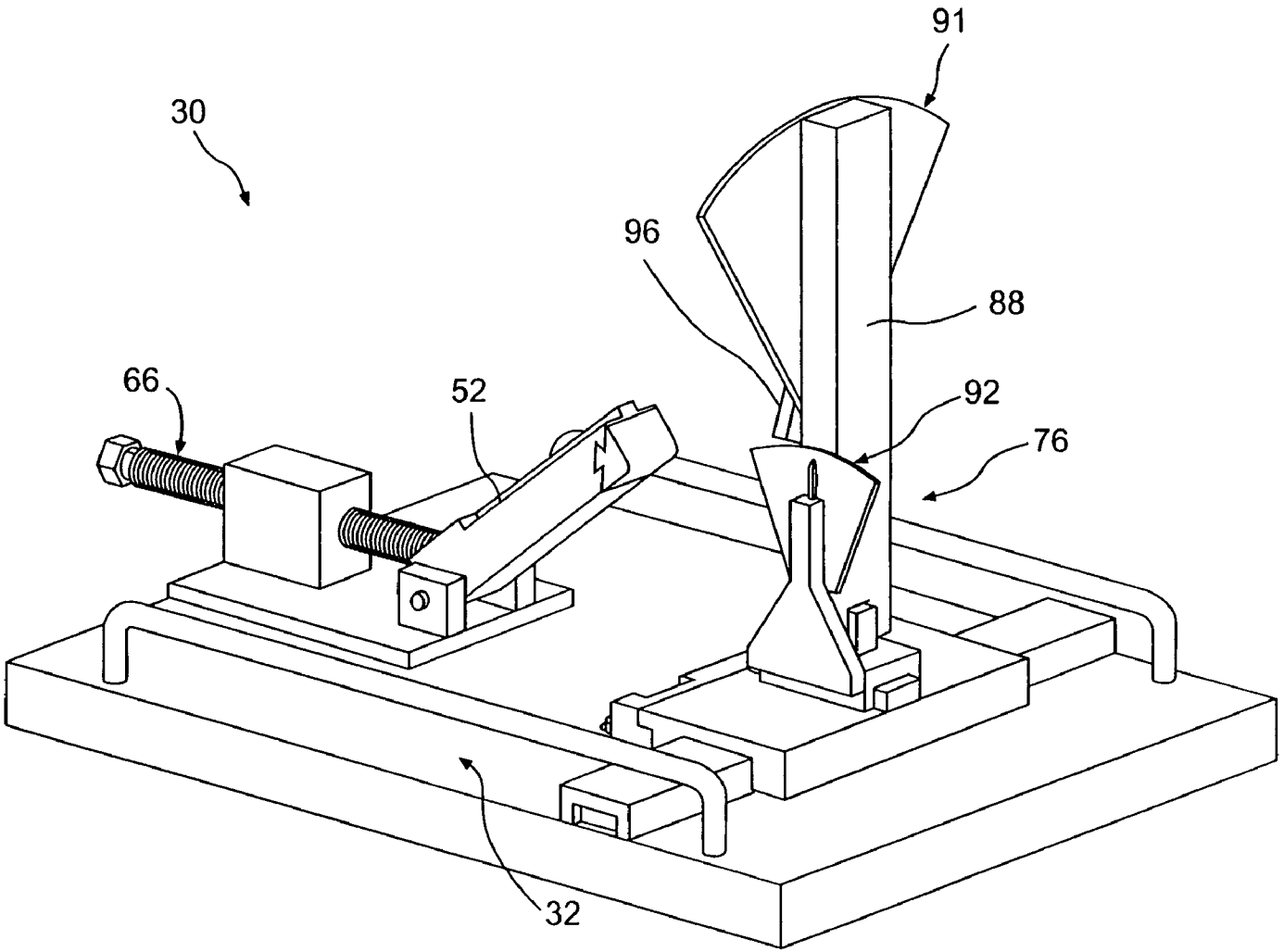
FIG. 4 is a rear, perspective view of the fixture of FIG. 2.
Figure 5:
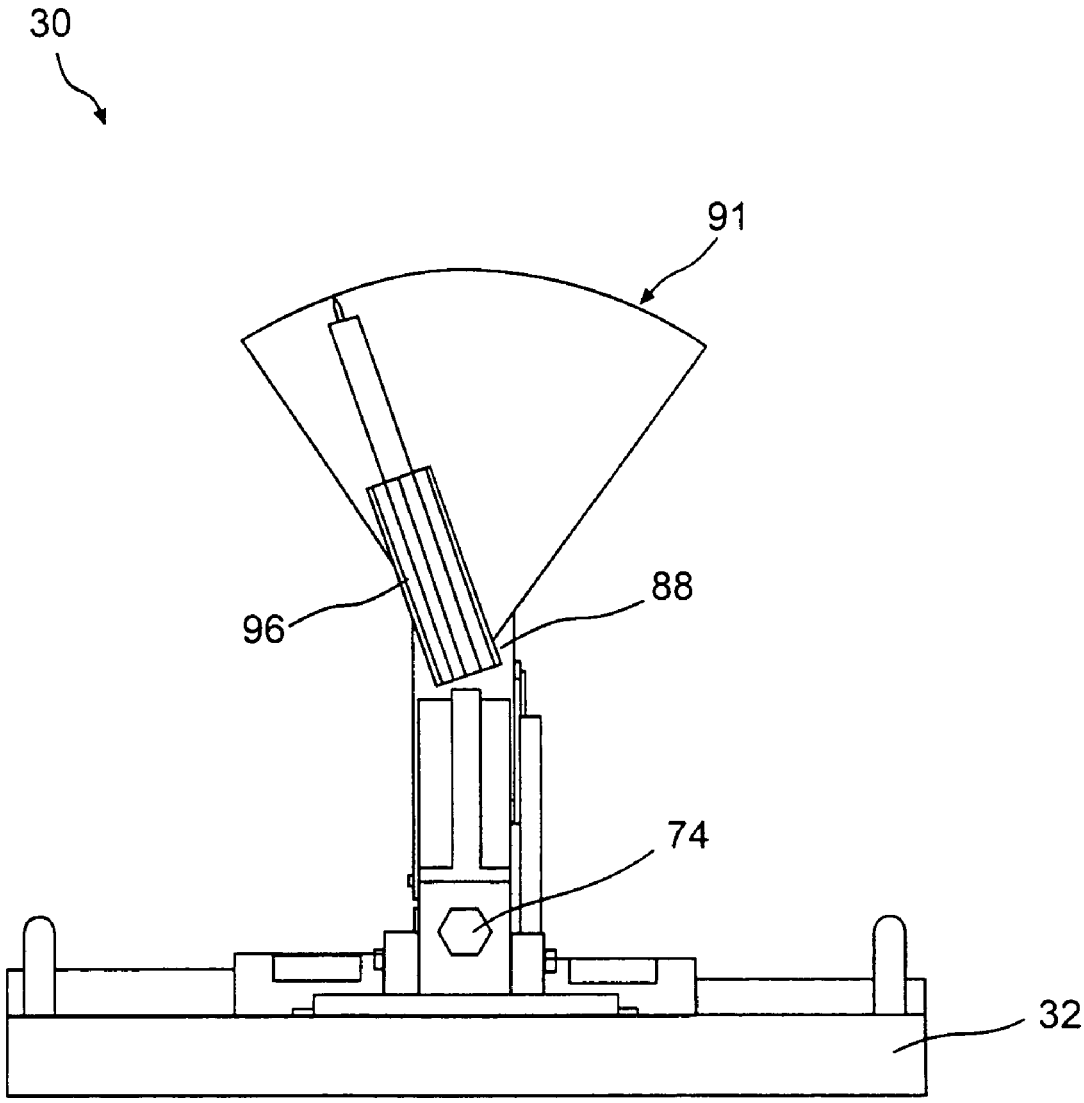
FIG. 5 is a front view of the fixture of FIG. 2.
Figure 6:
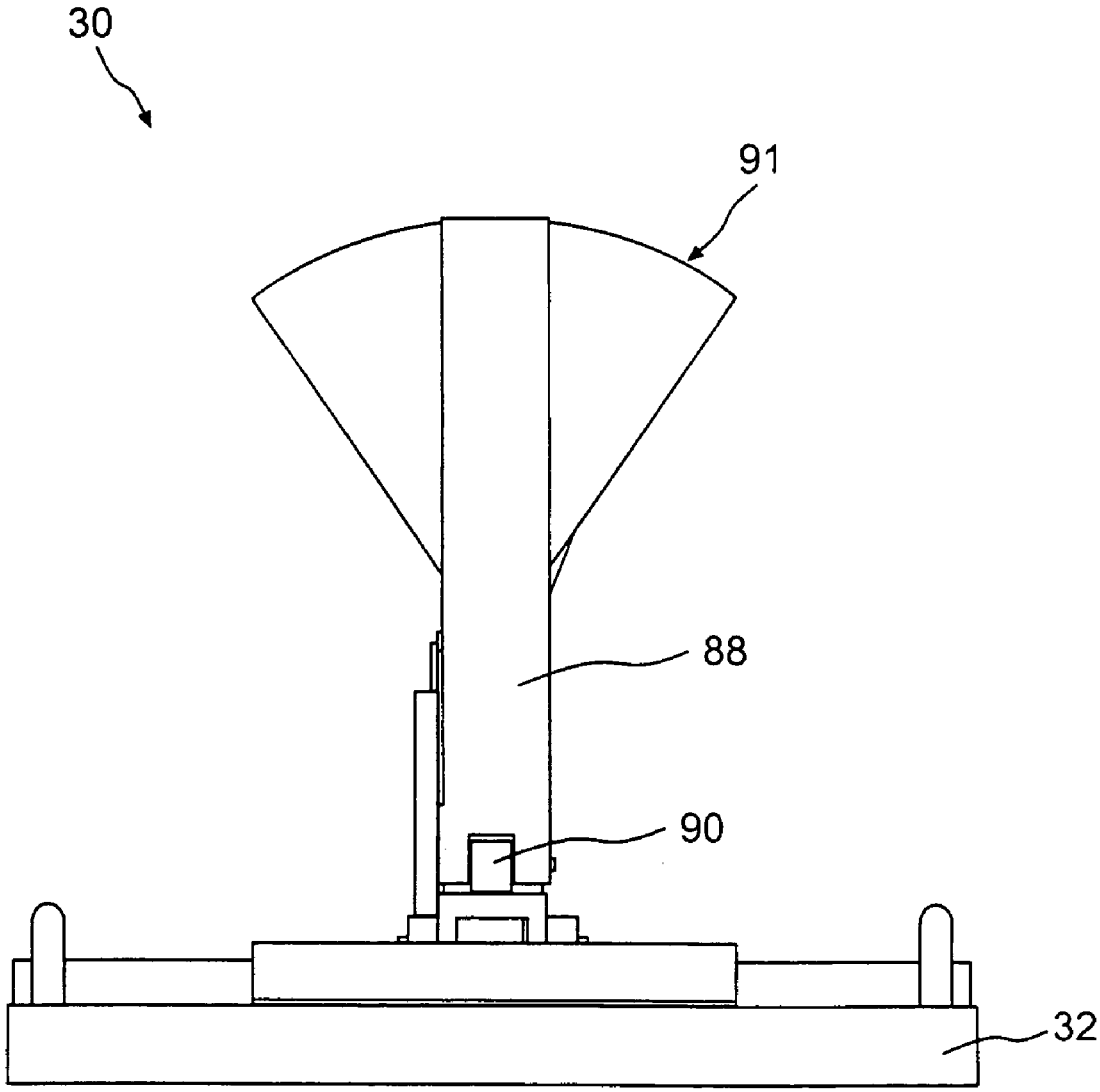
FIG. 6 is a back view of the fixture of FIG. 2.
Figure 7:
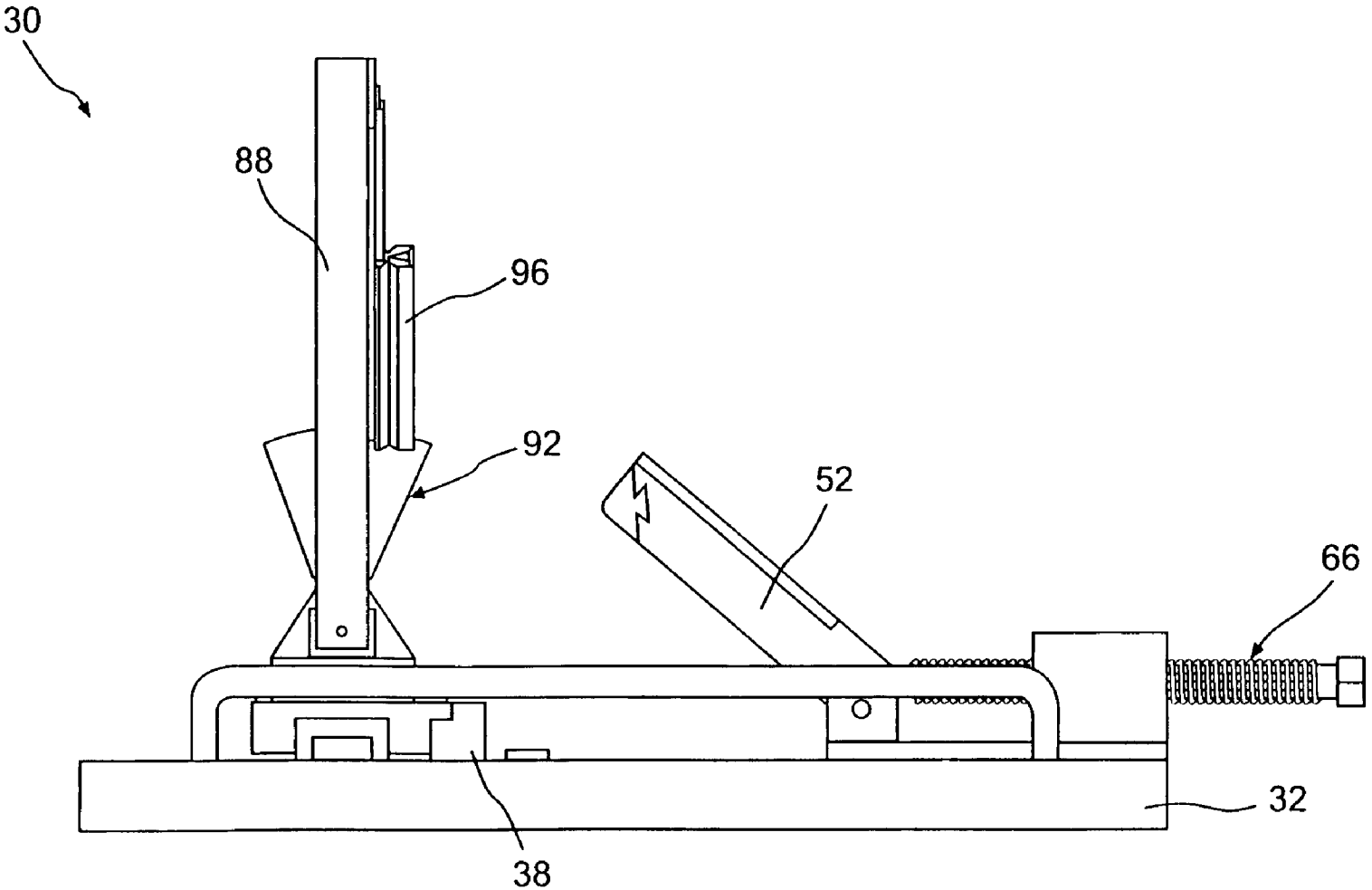
FIG. 7 is a left side view of the fixture of FIG. 2.
Figure 8:
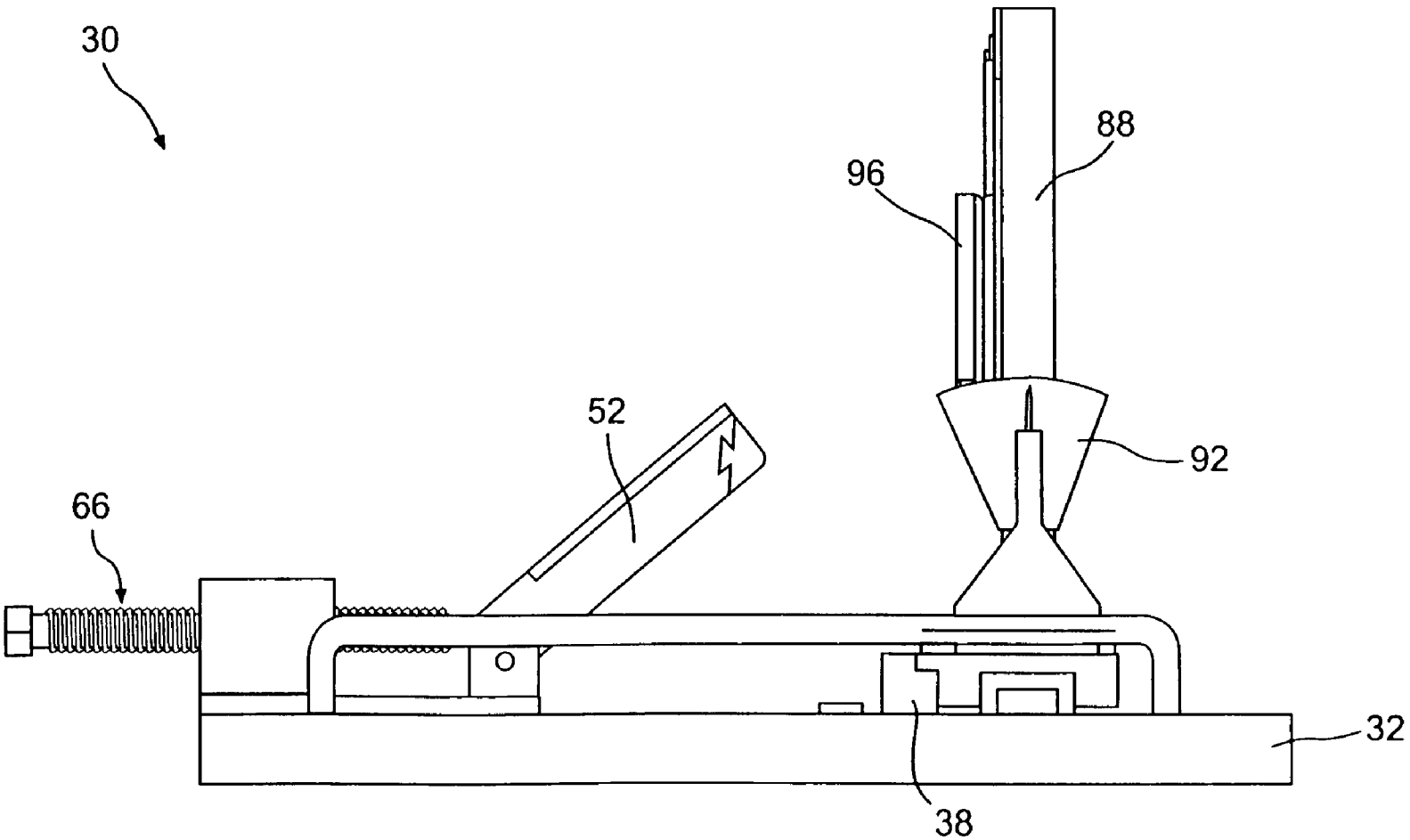
FIG. 8 is a right side view of the fixture of FIG. 2.

Other than in the operating examples, or unless otherwise expressly specified, all of the numerical ranges, amounts, values and percentages such as those for amounts of materials, moments of inertias, center of gravity locations, loft angles and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Referring to FIGS. 2–10, a device for fixing golf clubs is shown. As shown in particular in FIG. 2, golf club fixture 30 includes a base member 32 and handles 34, 36 so that fixture 30 may be easily transported to various locations. If desired, various clamping devices, such as C-clamps, may be placed about the periphery of base member 32 to secure fixture 30 to a working surface. An abutment 38 is disposed on base member 32 perpendicular to top surface 40 for anchoring a club head in a predetermined position on fixture 30. The strike face of a golf club, preferably a putter 41, is placed against surface 42. While use of fixture 30 is described herein with reference to a putter 41, other geometries of clubs are contemplated for use with the present invention. In the case of a putter with a face having an upper straight edge 45 that is parallel to the sole 46, the straight edge is preferably aligned parallel to leading edge 44 of abutment 38, which is also parallel to top surface 40. The sole 46 of putter 41 rests on a pair of leveling bearings 48, 50, as will be described shortly.

A clamping member 52 is pivotably mounted about a pin 54 retained between opposing supports 56, 58. Clamping member 52 includes a forward portion 60 with a resilient front 62. Preferably, resilient front 62 is formed of a slightly deformable rubber or other polymer that can be compressed upon contact with the back face of putter 41. During use of fixture 30, clamping member 52 is pivoted about pin 54 such that the leading face 64 of clamping member 52 is generally parallel to surface 42 and the central alignment axis 63 of clamping member 52 is generally perpendicular to surface 42. A clamping screw 66 is threadbly associated with a hole 68 in block 70, and clamping screw 66 may be used to exert a force against back face 72 of clamping member 52 so that the strike face of putter 41 is firmly held against surface 42 of abutment 38. To facilitate turning of clamping screw 66, a hex head 74 or other means, such as a lever, may be provided.

An alignment member 76 is coupled to base member 32, and includes a carriage portion 78 for generally aligning the alignment member 76 with respect to putter 41. In the preferred embodiment, carriage portion 78 includes first and second rails 80, 82, respectively, and their associated rigs 84, 86. First rail 80 slides on rig 84, which is oriented substantially parallel to surface 42 of abutment 38. Second rail 82 slides on rig 86, which is oriented substantially perpendicular to surface 42. Thus, alignment member 76 may be positioned along top surface 40 of base member 32. Alignment member 76 includes a post 88 that is pivotably mounted to a block 90 for movement in a plane perpendicular to surface 42.

A lie angle indicator 91 and a loft angle indicator 92 are provided, and in the preferred embodiment are disposed perpendicular to each other. Lie angle indicator 91 includes a scale portion 94, which preferably has calibrated indicia for displaying changes in angular increments. Scale 94 is fixed with respect to post 88. A cradle 96 is pivotably mounted about a pin 98 (for left/right motion), and includes an upper, needle portion 100. Loft angle indicator 92 includes a scale portion 102, also including calibrated angular indicia, and scale portion 102 is fixed with respect to post 88 (for front/back motion). Surfaces 104, 106 of indicators 91, 92, respectively, are perpendicular to each other. Loft angle indicator 92 also includes a needle portion 108, which is fixed to rig 86. Cradle 96 may be provided with one or more grooved regions 99, shown for example in FIG. 3, for accommodating the shaft of the club as will be explained. In one embodiment, three parallel grooves are provided to particularly accommodate left-handed (right side of cradle), right-handed (left side of cradle), and neutrally disposed shafts.

During use of fixture 30, a putter 41 is locked in place against surface 42 of abutment 38 so that the strike face of the putter abuts surface 42. Alignment member 76 is positioned with carriage portion 78 and pivoted with respect to block 90, and cradle 96 is pivoted about pin 98, so that the shaft 110 of putter 41 rests within and against cradle 96, which is centrally aligned with respect to needle 100. Because hosel portion 112 of putter 41 is milled at a 90° angle with respect to the sole 46, true readings of the loft and lie of the club may be obtained using fixture 30. With shaft 110 abutting cradle 96, which has been pivoted to receive shaft 110 concurrently with the pivoting of needle 100, the lie angle may be read from calibrated and preset scale portion 94, as indicated by needle 100. Likewise, in this position with shaft 110 resting in cradle 96, post 88 is pivoted and the loft angle may be read from calibrated and preset scale portion 102, as indicated by needle 108.

Figure 9:
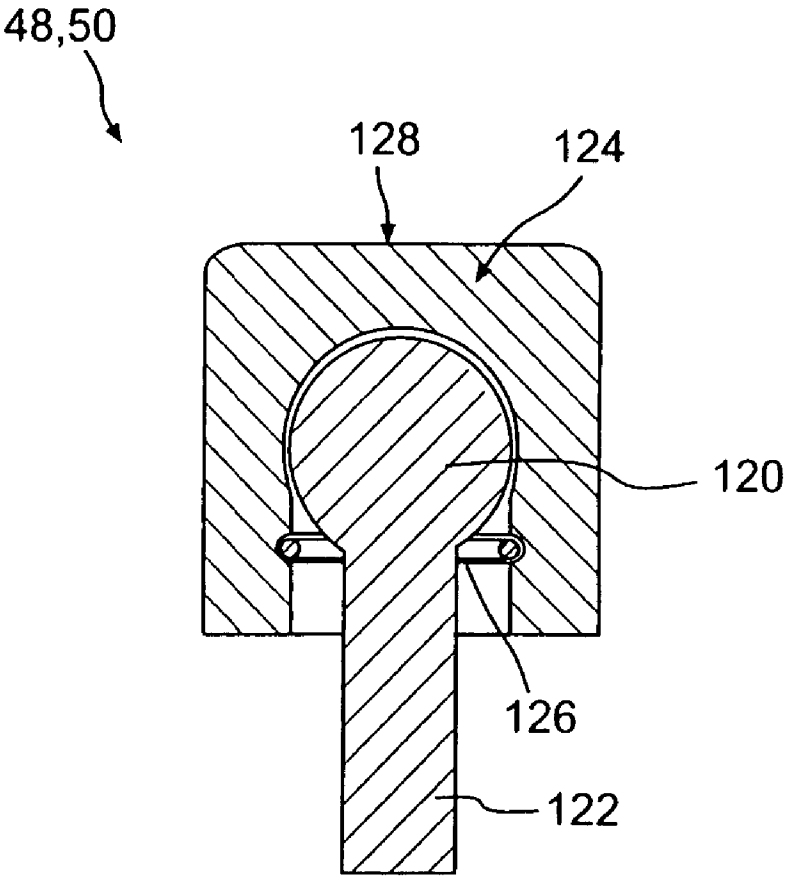
FIG. 9 is a partial cross-sectional view of a leveling bearing of the fixture of FIG. 2.

With reference to FIG. 9, leveling bearings 48, 50 include a spherical ball 120 disposed on a post 122, and a cap 124 disposed on ball 120. A mechanical interlock 126 prevents removal of cap 124 from ball 120. When a putter sole 46 rests on upper surface 128 of a bearing 48, 50, the cap 124 swivels on ball 120. This motion permits the squaring of the putter strike face while accommodating variations in the geometry of sole 46, thereby allowing sole 46 to be supported over a greater surface area.

Figure 10:
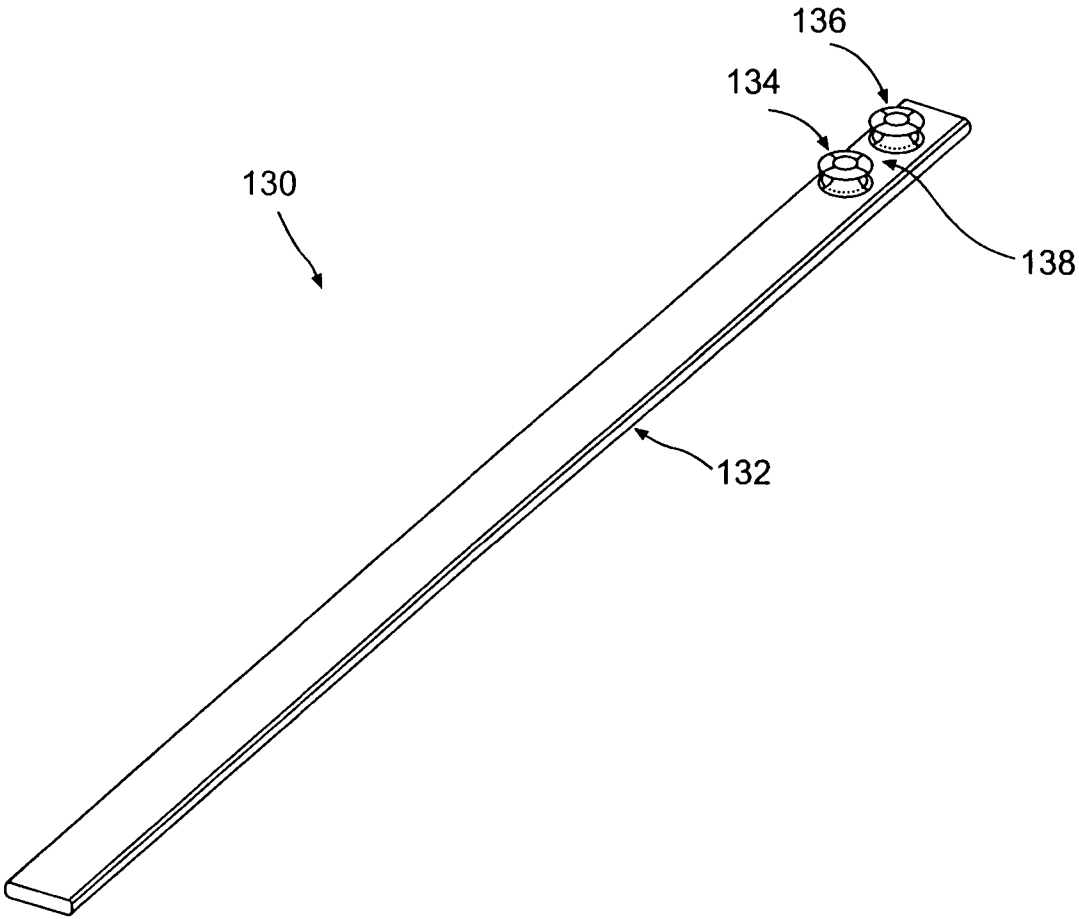
FIG. 10 is an adjusting bar according to the present invention.

Turning to FIG. 10, an adjusting bar 130 is provided for bending the shaft 110 of putter 41 so that desired lie angle can be achieved. If measurement of the lie angle using fixture 30 indicates that an undesired lie angle is set for putter 41, adjusting bar 130 may be used to change the lie angle, which may then be verified using fixture 30. Adjusting bar 130 includes a bar 132 with two protrusions 134, 136 disposed thereon. The protrusions define a slot 138 therebetween, which receives a putter shaft for contouring to the desired lie angle. Preferably, each of the protrusions is a wheel that is rotatably secured to bar 132 and have a diameter greater than about 0.1 inches and less than about 0.25 inches. More preferably, the diameter of protrusions 134, 136 is about ⅜ inch. In the preferred embodiment, slot 138 is between about 1 to 4 inches, and more preferably about 2.5 inches. Typically, shaft 110 is held to the head of putter 41 with epoxy. Protrusions 134, 136 are radiused to match the diameter of shaft 110. Thus, during bending of shaft 110, the creation of stress points due to the bending motion can be minimized. Preferably bar 132 is sufficiently long to provide leverage for a user, and may be about 24 inches in overall length.

Figure 11:
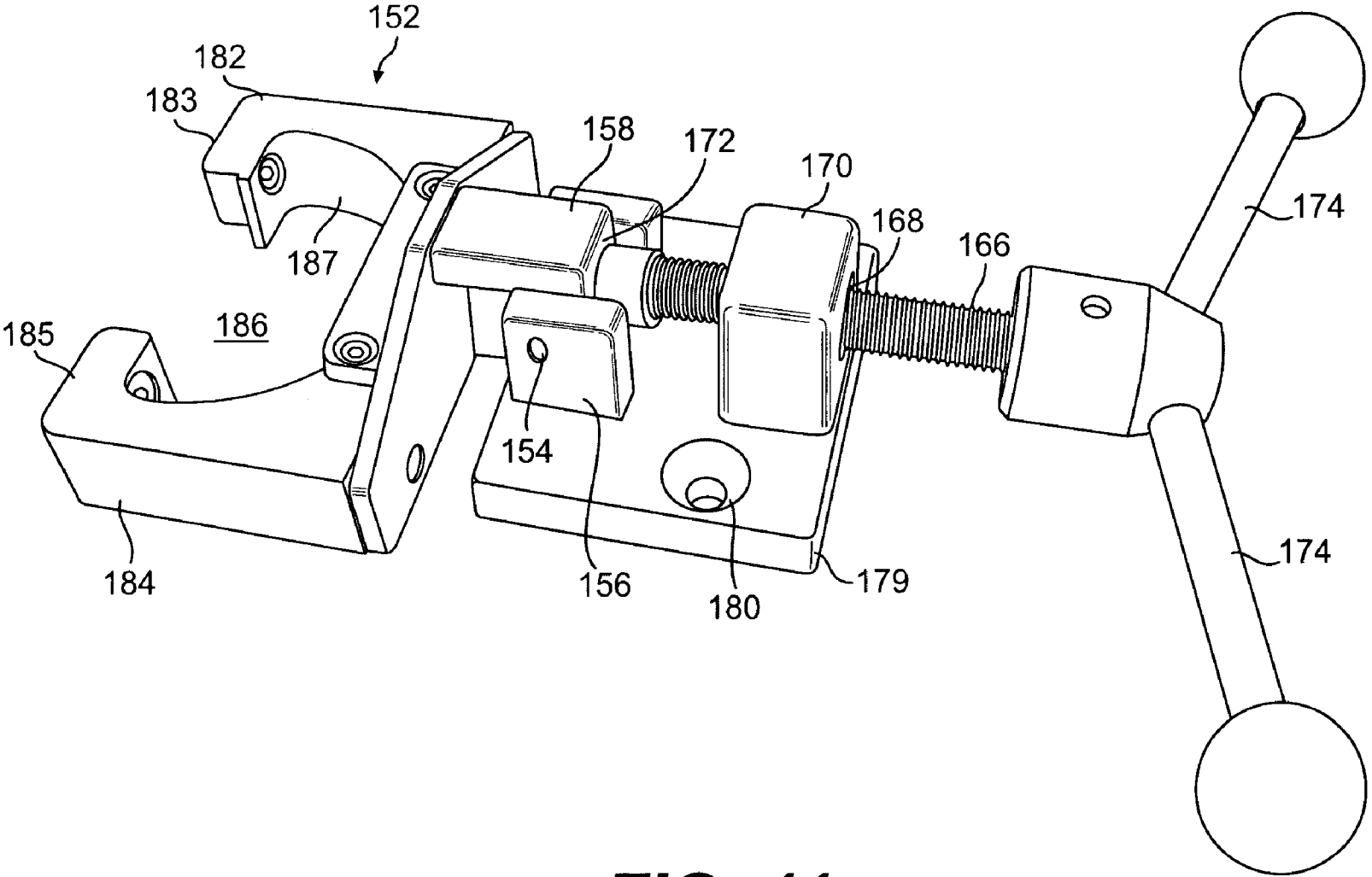
FIG. 11 is a perspective view of a clamping member for use with the fixture of FIG. 2.

FIG. 11 is a perspective view of a clamping member 152 for use with fixture 30. Clamping member 152 may be removably coupled to base member 32 by one or more holes 180 in attachment plate 179 through which one or more bolts or other fasteners can be engaged with base member 32. Similarly to clamping member 52, clamping member 152 is pivotably mounted about a pin 154 and retained between opposing supports 156, 158. Clamping member 152 includes two arms 182, 184 that define a void 186 therebetween. In one preferred embodiment, ends 183, 185 of arms 182, 184 are configured to engage at least a part of the rear portion of a golf club head. In the illustrated embodiment, clamping member 152 is configured for use with a space-age golf putter, such as the Futura® putter by Titleist®. This putter includes a face member having a strike face, an elongate body member coupled to a central region of a rear portion of the strike face and extending away therefrom, and a weight member coupled to a rear end of the body member. Ends 183, 185 are configured to engage a rear portion of the strike face, while the extended body and weight member of the putter are enveloped by void 186. There may or may not be contact between the rear parts of the putter and arms 182, 184. In the illustrated embodiment, ends 183, 185 are flared inward to provide additional contact surface. Ends 183, 185 that engage the club to be retained within fixture 30 may be provided with a resilient material, as discussed above. During use of fixture 30, clamping member 152 is pivoted about pin 154 such that arms 182, 184 are generally parallel to surface 40. A clamping screw 166 is threadbly associated with a hole 168 in block 170, and clamping screw 166 may be used to exert a force against back face 172 of clamping member 152 so that the strike face of club is firmly held against surface 42 of abutment 38. To facilitate turning of clamping screw 166, arms 174 or other means may be provided. The club can then be measured and manipulated as discussed above.

Alternatively, void 186 is configured to matingly engage at least a part of the rear portion of the club. This may be done, for example, with a mallet style putter. A mallet style putter has a broad head as measured from the strike face rearward. During use, clamping member 152 is pivoted forward about pin 154 such that inner surface 187 of arms 182, 184 engages at least a part of the rear portion of the golf club to be retained. Inner surface 187 may be provided with a resilient material. Clamping screw 166 may then be engaged to exert a force against back face 172 of clamping member 152 so that the strike face of club is firmly held against surface 42 of abutment 38. In this embodiment, arms 182, 184 preferably are not flared inward. Clamping member 152 preferably is selected from a group of clamping members, with each clamping member of the group tailored to a specific golf club. Preferably, each of the clamping members of the group of clamping members is at least partially contoured to its specific golf club.

While various descriptions of the present invention are described above, it should be understood that the various features can be used singly or in any combination thereof. Therefore, this invention is not to be limited to only the specifically preferred embodiments depicted herein.

Further, it should be understood that variations and modifications within the spirit and scope of the invention may occur to those skilled in the art to which the invention pertains. For example, digital readouts of the scales may be provided using electronic sensors, instead of scales with mechanical needles. Accordingly, all expedient modifications readily attainable by one versed in the art from the disclosure set forth herein that are within the scope and spirit of the present invention are to be included as further embodiments of the present invention. The scope of the present invention is accordingly defined as set forth in the appended claims.

What is claimed is:

1. A device for measuring alignment of a golf club with a shaft and a head having a strike face and a rear portion opposite the strike face, comprising:

a base member;

an abutment member coupled to said base member for abutting the strike face;

a clamping member removably coupled to said base member, said clamping member being selected from a group of clamping members and configured to engage at least a part of the rear portion; and an alignment member coupled to said base member and spaced from said clamping member;

wherein the positioning of said alignment member simultaneously indicates the loft angle and lie angle of the golf club; and wherein said clamping member and said alignment member are coupled to said base member on opposite sides of said abutment member.

2. The device of claim 1, further comprising a carriage adjustably coupled to said base member, and wherein alignment member is coupled to said carriage member such that said carriage is intermediate said base member and said alignment member.

3. The device of claim 1, wherein said abutment member is coupled to said base member intermediate said clamping member and said alignment member.

4. The device of claim 1, wherein said alignment member is slidably coupled to said base member such that said alignment member may be slidably positioned from a first position adjacent a first side of said base member to a second position adjacent a second side of said base member, said second side being opposite said first side.

5. The device of claim 1, wherein each clamping member of said group of clamping members is tailored to a specific golf club.

6. The device of claim 5, wherein in each clamping member of said group of clamping members is at least partially contoured to its specific golf club.

7. The device of claim 1, wherein said clamping member is adapted to fix the golf club head in a first direction between said clamping member and said abutment member.

8. The device of claim 7, wherein said alignment member is adapted to receive the golf club shaft in a second direction.

9. The device of claim 8, wherein said second direction is substantially perpendicular to said first direction.

10. A device for measuring alignment of a golf club with a shaft and a head having a strike face and a rear portion opposite the strike face, comprising:

a base member;

an abutment member coupled to said base member for abutting the strike face;

a clamping member removably coupled to said base member, said clamping member including two arms defining a void therebetween; and an alignment member coupled to said base member and spaced from said clamping member;

wherein the positioning of said alignment member simultaneously indicates the loft angle and lie angle of the golf club; and wherein said clamping member and said alignment member are coupled to said base member on opposite sides of said abutment member.

11. The device of claim 10, wherein said void is configured to matingly engage at least a part of the rear portion.

12. The device of claim 10, wherein said abutment member is coupled to said base member intermediate said clamping member and said alignment member.

13. The device of claim 10, wherein ends of said arms are configured to engage at least a part of the rear portion.

14. The device of claim 13, wherein said ends engage a rear portion of the strike face.

15. The device of claim 13, wherein said arms and said void are configured such that said void envelops at least a part of the rear portion.

16. The device of claim 10, wherein said clamping member is selected from a group of clamping members, each clamping member of said group of clamping members being tailored to a specific golf club.

17. The device of claim 16, wherein in each clamping member of said group of clamping members is at least partially contoured to its specific golf club.

18. The device of claim 10, wherein said clamping member is adapted to fix the golf club head in a first direction between said clamping member and said abutment member.

19. The device of claim 18, wherein said alignment member is adapted to receive the golf club shaft in a second direction.

20. The device of claim 19, wherein said second direction is substantially perpendicular to said first direction.

* * * * *